United States Patent [19]

Phillips

[11] Patent Number: 4,586,211

[45] Date of Patent: May 6, 1986

[54] TILE SURFACE CLEANING APPARATUS

[76] Inventor: Dan D. Phillips, 442 Lyttleton Dr., Charlotte, N.C. 28211

[21] Appl. No.: 693,115

[22] Filed: Jan. 22, 1985

[51] Int. Cl.[4] ..... A47L 11/19

[52] U.S. Cl. ..... 15/49 C; 15/79 A; 15/179; 15/182; 15/DIG. 6

[58] Field of Search ..... 15/49 C, 50 C, 55, 79 A, 15/82, 179, 181, 182, 183, 383, DIG. 6

[56] References Cited

U.S. PATENT DOCUMENTS

| | | | |
|---|---|---|---|
| 1,590,671 | 6/1926 | Campbell | 15/49 C |
| 1,892,347 | 12/1932 | Jerome . | |
| 1,957,506 | 5/1934 | Smellie . | |
| 2,558,590 | 6/1951 | Smith | 15/50 C |
| 3,072,940 | 1/1963 | Kelly | 15/49 C |
| 3,344,453 | 10/1967 | Price . | |
| 3,518,819 | 7/1970 | Schneider | 15/179 |
| 3,570,040 | 3/1971 | Wada . | |
| 4,324,015 | 4/1982 | Head . | |
| 4,402,101 | 9/1983 | Van Zyl . | |

FOREIGN PATENT DOCUMENTS

| | | | |
|---|---|---|---|
| 95146 | 1/1897 | Fed. Rep. of Germany | 15/179 |
| 2440229 | 7/1980 | France | 15/49 C |

*Primary Examiner*—Edward L. Roberts

*Attorney, Agent, or Firm*—Bell, Seltzer, Park & Gibson

[57] ABSTRACT

An apparatus for cleaning bathroom and other tile floors and similar tile surfaces includes a wheel-supported frame on which a motor-driven cylindrical scrubbing brush is mounted for surface engagement, the brush being particularly provided with plural circular rows of relatively long, stiff bristles at spacings along the length of the brush member corresponding to the spacings between the grout lines of the tile surface and a plurality of spiral rows of relatively shorter, softer bristles extending helically along the length of the brush member intermediate the circular bristle rows. Upon motor driven rotation of the brush member, the circular and spiral bristle rows are effective respectively to scrubbingly engage the grout lines and the tile surfaces for effective cleaning thereof.

10 Claims, 2 Drawing Figures

TILE SURFACE CLEANING APPARATUS

BACKGROUND OF THE INVENTION

The present invention relates generally to motorized apparatus for cleaning floors and similar surfaces and more particularly to such apparatus specifically adapted for work on grouted tile floors and surfaces.

There are a wide variety of well-known conventional types of apparatus wherein a motor driven rotatable brush or brushes are provided for scrubbing or otherwise cleaning various floor surfaces. Primarily, such floor cleaning apparatus are designed and intended for use on carpeted floor surfaces or, to a lesser extent, on wood or synthetic floor surfaces. Such apparatus generally perform entirely satisfactorily for the cleaning applications for which they are intended. However, there exists no known motorized scrubbing apparatus designed and effective for cleaning conventional tile surfaces of the type wherein a plurality of individual tiles are arranged and joined coplanarly by a cementitious material called grout. Such floor surfaces are typically employed in bathrooms, locker rooms and like areas.

In the conventional formation of such floor surfaces, the individual tiles are normally arranged uniformly at spacings from each other with the adhering grout material exposed in such spacings recessed from the outward tile surfaces. As a result, most of the dirt and debris on such tile floors tend to accumulate and concentrate predominantly in the grout areas. The amount and concentration of dirt and debris in the grout areas present significant problems in the cleaning of such tile surfaces, which problems are compounded by the recessed nature and relatively rough surface texture of the grout areas. Accordingly, conventional types of floor cleaning apparatus are entirely inappropriate and ineffective in cleaning such tile surfaces. Furthermore, no specialized apparatus for cleaning such surfaces is known to be available or to have been proposed. Instead, tile surfaces of the type herein concerned are conventionally cleaned by either manual scrubbing, which is time consuming, laborious and generally distasteful, or by the application of relatively strong chemical compositions. These chemical compositions, while effective for the intended purpose, may be toxic or harmful to humans, and require special and careful handling and use, thereby significantly increasing the cost of cleaning such tile surfaces.

In contrast, the present invention provides a novel motorized apparatus having a brush member particularly designed for cleaning the grout and tile surfaces of conventional tile floors.

Briefly described, the tile surface cleaning apparatus of the present invention includes a frame, an elongated brush member rotatably mounted thereon for engagement with the tile surface, and a driving arrangement, e.g. a motor, mounted on the frame for rotating the brush member in engagement with the tile surface. The brush member is provided with first bristles arranged circularly about the brush member at spacings along its length for cleaning engagement in the recessed grout areas and second bristles arranged about the brush member intermediately of the first bristles for cleaning engagement with the outward surfaces of the tiles.

In the preferred embodiment, the brush member is cylindrical and is mounted beneath the forward end of the frame. The first bristles are arranged in circular rows around the full periphery of the brush member at spacings along the length thereof substantially equal to or an integral multiple of the spacings between the grout lines. The second bristles are arranged in a plurality of correspondingly spiraled rows extending along the brush member intermediately of the circularly arranged bristle rows at substantially equal spacings about the periphery of the brush member with each spiraled bristle row making at least one substantially full spiral about the brush member. Individual bristles in the circularly arranged bristle rows are relatively longer and stiffer than those in the spirally arranged bristle rows for cleaning engagement of the circularly arranged bristle rows with the recessed grout lines and for cleaning engagement of the spirally arranged bristle rows with the outward tile surfaces. In one preferred embodiment, the bristles in the circularly arranged rows have a length of about one inch (1") while those bristles in the spirally arranged rows have a length of about seven-eighths of an inch ($\frac{7}{8}$").

Preferably, casters or other wheels are mounted dependingly from the rearward end of the frame for rollingly supporting the frame on the tile surface cooperatively with the brush member. A handle is affixed to and extends rearwardly from the frame for permitting manual control of the rolling movement of the frame on the tile surface.

BRIEF DESCRIPTION OF THE DRAWINGS

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein.

DETAILED DESCRIPTION OF THE INVENTION

Figure 1:
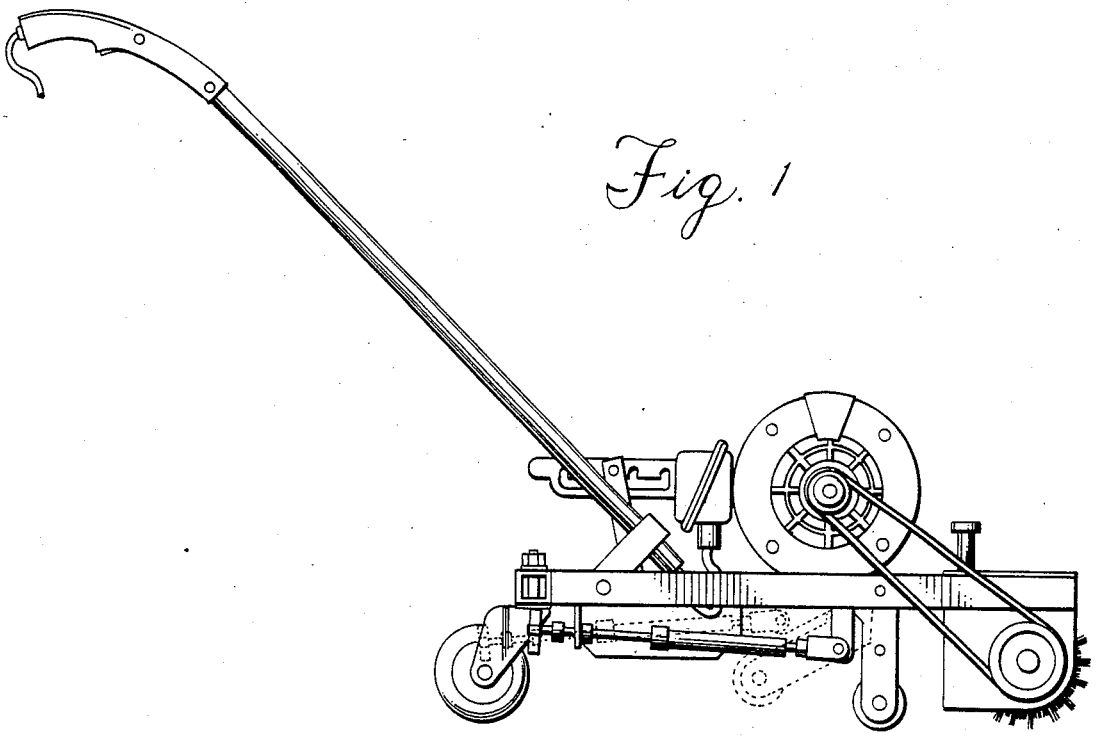
FIG. 1 is a side elevational view of a tile surface cleaning apparatus according to the preferred embodiment of the present invention.

Referring now to the accompanying drawings and initially to FIG. 1, the tile surface cleaning apparatus of the present invention is indicated therein generally at 10. Basically, the cleaning apparatus 10 includes a substantially horizontal frame 12, a cylindrical brush member 14 rotatably mounted beneath the forward end of the frame 12, a wheel arrangement 16 mounted dependingly from the rearward end of the frame 12, an electric motor 18 mounted on the upwardly facing surface of the frame 12 in belt driving connection with the brush member 14, and a handle 20 affixed to and extending rearwardly from the frame 12 for operational control of the apparatus 10.

The frame 12 is a substantially rectangular framework of square metal tubing 22 welded together end-to-end. Appropriate cross members (not shown) are welded to and extend transversely between the side tubing members 22 for bolted affixation to such cross members of the motor 18. Another cross-member (also not shown) is affixed between the side tubing members 22 to extend transversely therebetween for rotation about the longitudinal axis of this cross member. The handle 20 is affixed by a mounting block 24 to such rotatable cross member to permit variable angular disposition of the handle 20 relative to the frame 12. An adjusting arm 26 is affixed to the rotatable cross member in a generally upstanding position for unitary pivotal movement with the handle 20 about the rotatable cross member. The arm 26 has a pin 28 at its extending end which can be selectively engaged by such pivotal movement in any one of several notches 30 in a retaining arm 32 supported by the frame 12 at a slight elevation thereabove. In this manner, the angular disposition of the handle 20 relative to the frame 12 can be selectively adjusted as desired by the operator. The frame 12 also includes a pair of bearing members 34 affixed correspondingly in facing relation to one another at the forward ends of the side tubing members 22 to act as bearing supports for the brush member 14, as hereinafter more fully explained.

The rear wheels 16 are mounted rotatably in two caster assemblies 36 bolted to opposite ends of the rearward tubing member 22 for swivel movement about respective vertical axes. As will be understood, the wheels 16 and the brush member 14 cooperatively facilitate rolling movement of the frame 10 on a tile floor or other similar surface, the swivel caster assemblies 36 permitting selective turning movement of the frame 12.

A pair of auxiliary wheels 38 are rotatably mounted at the free ends of a pair of legs 40 pivotably supported dependingly from the two side tubing members 22. A cross member (not shown) extends horizontally between the legs 40 and has a connecting arm 42 rigidly affixed to the longitudinal center thereof to extend downwardly therefrom. An actuating arm 44 is pivotably affixed at one end to the depending end of the connecting arm 42 and has its other end extending through a slotted opening in a support bracket 46 which is affixed to the underside of the rearward tubing member 22. In this manner, longitudinal movement of the actuating arm 44 forwardly of the frame 12 pivots the legs 40 into an upstanding diposition wherein their wheels 38 are in a floor engaging position, as shown in full lines in FIG. 1. A stop member 48 is provided on the actuating arm 44 for engagement with the bracket 46 to retain the actuating arm 44 in the forward disposition and the legs 40 and wheels 38 in the floor engaging position. In such position, the wheels 38 extend downwardly from the frame 12 to a greater extent than the lowermost periphery of the brush member 14 so that the apparatus 10 is adapted for non-operational rolling movement on a floor or other surface supported by the wheels 16 and 38, and with the brush member 14 maintained out of engagement with the floor or other surface. Disengagement of the stop member 48 from the bracket 46 and rearward longitudinal movement of the actuating arm 44 relative to the frame 12 causes pivotal movement of the legs 40 and wheels 38 upwardly toward the frame 12 and out of the floor engagement position, as shown in broken lines in FIG. 1. In this withdrawn position of the legs 40 and wheels 38, the apparatus 10 is adapted to be supported for rolling operational movement on a floor or other surface by the wheels 16 and the brush member 14.

The motor 18 may be of any appropriate conventional type, but is preferably an electric motor of a heavy duty rating suitable for generating rotational speeds of the brush member 14 through a direct belt drive at speeds on the order of approximately 800 revolutions per minute or greater. The necessary electrical leads for connection of the electrical motor 18 to a conventional source of operating electrical current are housed within a conventional insulating sheath 50 which extends from the electrical motor 16, through the handle 20, and therefrom a selected length. An actuating switch operated by button 51 on the handle 20 is provided in the electrical leads for permitting convenient stopping and starting of the apparatus 10 by an operator. The motor 18 includes a drive shaft 52 on the outwardly extending end of which is fixedly mounted a toothed pulley 54.

Figure 2:
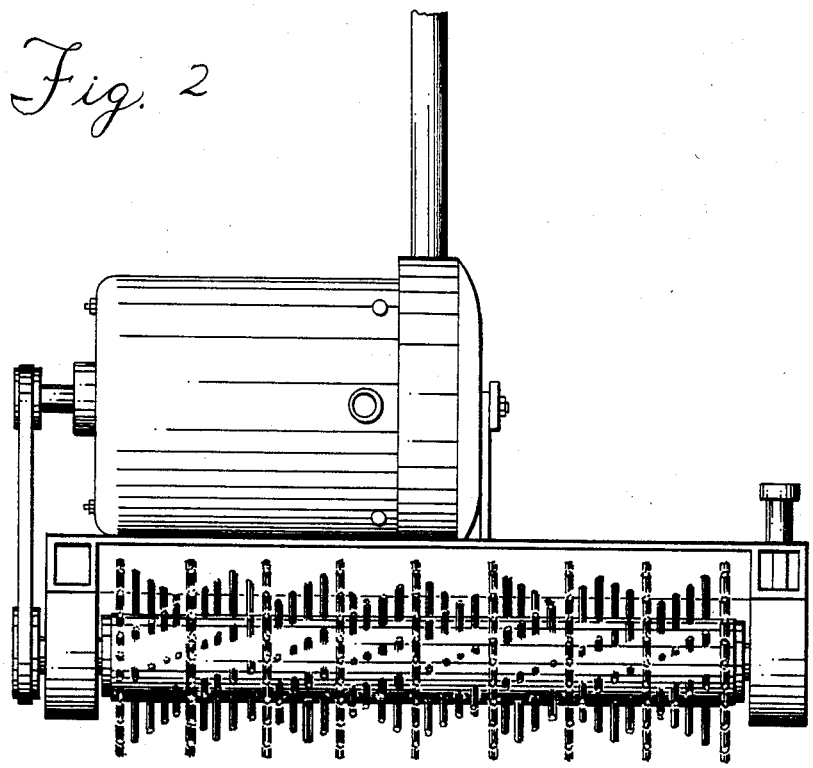
FIG. 2 is a slightly enlarged front elevational view of the tile surface cleaning apparatus of FIG. 1 showing the brush member in cleaning engagement with a conventional tile floor.

The brush member 14 is best seen with reference to FIG. 2. The brush member 14 includes a central elongated cylindrical core 56 having supporting stub shafts 58 extending coaxially from the opposite ends thereof. The stub shafts 58 are rotatably supported in appropriate journals in the bearing members 34, with the stub shaft 58 at the forward left side of the apparatus 10 (as viewed in FIG. 2) extending outwardly through its supporting bearing member 34, and having rigidly affixed thereto a toothed pulley 60. An endless, inwardly-toothed timing belt 62 is trained about the pulleys 54, 60 to provide a driving connection between the electric motor 18 and the brush member 14. As will be understood, the sizes of the pulleys 54, 60 are selected in conventional manner and relation to one another and to the rated rotational output of the motor 18 to produce the desired rotational speed of the brush member 14. The bearing member 34 at the forward right side of the apparatus 10 is held in place on the frame 12 by a bolt 59 which may be readily loosened and removed for quick and convenient replacement of the brush member 14.

A typical conventional tile floor is indicated in FIG. 2 generally at F. The floor F includes a plurality of tiles T which are adhered to a sub-floor A by a layer L of cementitious material commonly referred to as "grout". Tiles such as the tiles T are conventionally available and used in a variety of differing shapes and sizes. However, tiles of a one inch square size and configuration constitute the vast majority of all tiles utilized for bathroom and like tile floors. Furthermore, most other tiles utilized are also of a square or rectangular configuration, the transverse dimensions of which are normally integral multiples of one inch. Accordingly, in FIG. 2, the tiles T shown are representative of the most common one inch square tiles. The tiles T are arranged on the grout layer L in linear rows and columns at uniform, relatively small spacings from one another thereby leaving an upwardly exposed network of intersecting, perpendicularly extending grout lines G between the tiles T. Notably, the grout lines G are recessed from the upwardly facing surfaces S of the tiles T by a small dimension D, the side edges of the tiles T being slightly rounded to merge with the recessed grout lines G.

The brush member 14 further includes first and second sets of resilient bristle means 64, 66, respectively. The first bristle means 64 are affixed to the central core 56 of the brush member 14 in a plurality of circular rows extending fully around the entire periphery of the core 56, the plural rows of the circularly arranged bristles 64 being spaced from one another along the full length of the core 56 at substantially the same dimension as either the lengthwise or widthwise dimension of the tiles T or an integral multiple thereof, i.e., at substantially the same spacing, or an integral multiple thereof, between the grout lines G between the tiles T.

The second bristle means 66 are affixed to the core 56 between the circularly arranged rows of bristles 64 to extend along the length of the core 56 in a plurality of spiral rows at substantially the same helix angle and at substantially equal spacings about the periphery of the core 56. The helix angle at which the spirally arranged rows of the bristles 66 extend is preferably selected so that each spirally arranged row of the bristles 66 makes one complete 360 degree spiral about the core 56 from one end thereof to the other.

The circularly arranged bristles 64 are selected to be of a length greater than the length of the spirally arranged bristles 66 by the average dimension D by which the grout lines G are recessed from the upwardly facing surfaces S of the tiles T to thereby facilitate simultaneous cleaning engagement of the group lines G by the circularly arranged bristles 64 and of the upwardly facing tile surfaces S by the spirally arranged bristles 66. In one preferred embodiment of the invention, the circularly arranged bristles 64 are approximately one inch (1") in length and the spirally arranged bristles 66 are approximately seven-eighths of an inch ($\frac{7}{8}$") in length.

In addition, the circularly arranged bristles 64 are preferably relatively stiffer and coarser than the spirally arranged bristles 66 in due regard for the rougher, more abrasive surface texture of the grout lines G in comparison with the tile surfaces S and the expected greater accumulation and concentration of dirt and debris in the grout lines G. For example, the circularly arranged bristles 64 may preferably be formed of nylon filments of a 0.032 inch diameter with the spirally arranged bristles 66 formed of nylon filaments of a 0.008 inch diameter. In this manner, the brush member 14 will be understood to be uniquely and specially adapted for full and complete cleaning engagement with all exposed tile and grout surfaces of a conventional tile floor such as the floor F for providing an effective scrubbing action thereon when the brush member 14 is rotatably operated by the motor 18.

In operation, the apparatus 10 is positioned on a tile floor such as the floor F to be cleaned. The floor F is initially wetted with a conventional detergent or other appropriate liquid cleaning preparation. The electrical cord 50 is connected to a suitable source of electrical current for operating the motor 18. After appropriate adjustment of the handle disposition 20 as desired, the actuating arm 44 is moved longitudinally rearwardly of the frame 12 to withdraw the auxiliary wheels 38 to bring the brush member into resting rotatable engagemeent with the surface of the floor F. The motor 18 is then energized by depression of the button 51 on the handle 20 to actuate rotation of the brush member 14. With the button 51 continuing to be depressed, the apparatus 10 is rolled slowly across the entire surface of the floor F to bring the circularly and spirally arranged bristles 64, 66 into cleaning and scrubbing engagement with all grout lines G and with all of the upwardly facing surfaces S of the tiles T. In this manner, the rotational movement of the bristles 64, 66 scrubbingly works the cleaning solution into the grout lines G and onto the upwardly facing surfaces S of the tiles T to effectively clean all such areas and surfaces of the floor F. As will be understood, forward or rearward pressure may be exerted on the handle 20 during such operation of the apparatus 10 to effectively pivot the apparatus 10 respectively clockwise or counterclockwise (as viewed in FIG. 1) about the rear wheels 16 to increase or decrease, respectively, the pressure of engagement of the bristles 64, 66 against the floor F. In this manner, the apparatus 10 can be operated to provide a more rigorous scrubbing and cleaning action on areas of the floor F which are most soiled and to provide a relatively light scrubbing and cleaning action on the areas of the floor F which are least soiled.

As will be readily understood, the tile surface cleaning apparatus 10 is well adapted for operation in the above-described manner in cleaning substantially all conventional tile floors constructed with substantially all sizes and configurations of conventional tiles. As explained, the bristles 64, 66 of the brush member 14 are best and most readily adapted for cleaning and scrubbing engagement of conventional tile floors constructed of one inch square tiles. However, since substantially all other conventional tiles have transverse dimensions which are multiples of inches, the provision of the circularly arranged rows of bristles 64 at one inch spacings along the length of the core 56 of the brush member 14 and the flexibility of such bristles 64 enables at least some alternating ones of the circularly arranged rows of bristles 64 to achieve equally effective cleaning and scrubbing engagement in the grout lines between the tiles of such tile floors. At the same time, other circular rows of the bristles 64 flexibly deform as the spirally arranged bristles 66 are brought into engagement with the upward tile surfaces and thereby aid such spirally arranged bristles 66 in the cleaning and scrubbing of the tile surfaces. It will also be understood that the basic apparatus 10 of the present invention may be adapted for cleaning and scrubbing of other tile surfaces such as tile walls, countertops or the like.

Other adaptations and modifications of the apparatus 10 will also be recognized to come within the scope and substance of the present invention. For instance, the bristles 66 may be arranged intermediate the bristles 64 in many arrangements other than spiral arrangements. In some instances, it may be possible to utilize bristles 66 of the same length as the bristles 64 with the greater softness and flexibility of the bristles 66 facilitating simultaneous engagement of the bristles 64, 66 in the grout lines and with the tile surfaces.

The foregoing embodiments are to be considered illustrative, rather than restrictive of the invention, and those modifications which come within the meaning and range of equivalents of the claims are to be included therein.

That which is claimed is:

1. Apparatus for cleaning a tile surface of the type having an arrangement of tiles with generally coplanar outward surfaces and separated from one another by grout areas of cementitious material relatively recessed from said outward surfaces, said apparatus comprising:

a frame;

an elongated brush member rotatably mounted on said frame for engagement with said tile surface, said brush member having first bristle means arranged circularly about said brush member at spacings along the length thereof for cleaning engagement in said recessed grout areas and second bristle means arranged about said brush member intermediately of said first bristle means for cleaning engagement with said outward surfaces, and said second bristle means being relatively softer than said first bristle means; and driving means mounted on said frame for rotating said brush member for moving said first and second bristle means during their said engagements with said grout areas and said outward surfaces to provide a scrubbing action thereof.

2. Apparatus for cleaning a tile surface according to claim 1 and characterized further in that said first bristle means extends outwardly of said brush member to a relatively greater predetermined extent than said second bristle means for cleaning engagement by said first bristle means in said recessed grout areas and simultaneous cleaning engagement by said second bristle means with said outward surfaces.

3. Apparatus according to claim 2 in which said first bristle means have a length of about one inch (1").

4. Apparatus according to claim 2 in which said second bristle means have a length of about seven-eighths of an inch ($\frac{7}{8}$").

5. Apparatus for cleaning a tile surface according to claim 1 and characterized further in that said second bristle means extend spirally about said brush member along the length thereof.

6. Apparatus for cleaning a tile surface according to claim 1 and characterized further in that said first bristle means includes a plurality of circular rows of bristles around the periphery of said brush member, said circular bristle rows being spaced apart a predetermined distance substantially an integral multiple of the distance of spacing between said grout lines.

7. Apparatus for cleaning a tile surface according to claim 1 and characterized further in that said second bristle means includes a plurality of spiral rows of bristles extending along said brush member at substantially equal spacings peripherally about said brush member.

8. Apparatus for cleaning a tile surface of the type having an arrangement of tiles with generally coplanar outward surfaces and separated from one another at substantially equal spacings by grout areas of cementitious material relatively recessed from said outward surfaces, said apparatus comprising:

a frame;

an elongated brush member rotatably mounted at one end of said frame for engagement with said tile surface, said brush member having first bristle means including a plurality of rows of bristles circularly arranged around the periphery of said brush member, said circularly arranged bristle rows being spaced apart a predetermined distance substantially an integral multiple of the distance of spacing between said grout lines, and second bristle means including a plurality of rows of bristles spirally arranged and extending along said brush member at substantially equal spacings peripherally about said brush member:

said second bristle means being arranged intermediately of said first bristle means and said first bristle means extending outwardly of said brush member to a relatively greater predetermined extent than said second bristle means for cleaning engagement by said first bristle means with said recessed grout areas and simultaneous cleaning engagement by said second bristle means with said outward surfaces;

driving means mounted on said frame for rotating said brush member for moving said first and second bristle means during their said engagements with said grout areas and said outward surfaces to provide a scrubbing action thereof;

wheel means mounted at the opposite end of said frame from said brush member for permitting pivotal movement of said frame about said wheel means to vary selectively the force of engagement applied by said brush member to said surface.

9. Apparatus for cleaning a tile surface according to claim 8 and characterized further by handle means affixed to and extending from said frame for permitting manual control of rolling movement of said apparatus on said tile surface.

10. Apparatus for cleaning a bathroom or like tile floor of the type having a plurality of tiles arranged uniformly at selected spacings and with generally coplanar upward surfaces and having grout lines of cementitious material in said tile spacings relatively recessed from said upward surfaces of said tiles, said apparatus comprising:

a substantially horizontal frame;

an elongated cylindrical brush member rotatably mounted beneath the forward end of said frame for scrubbing engagement with said floor;

said brush member having a plurality of rows of bristles circularly arranged around the full periphery of said brush member at spacings along substantially the full length thereof, said spacings being substantially a multiple of the spacings between said grout lines;

said brush member further having a plurality of correspondingly spirally arranged rows of bristles extending along said brush member intermediately of said circularly arranged bristle rows at substantially equal spacings about the periphery of said brush member with each said spirally arranged bristle row making at least one substantially full spiral thereabout;

individual bristles in said circularly arranged bristle rows being relatively longer and stiffer than individual bristles in said spirally arranged bristle rows for cleaning engagement of said circularly arranged bristle rows with said recessed grout lines and for simultaneous cleaning engagement of said spiraled bristle rows with said upward tile surfaces;

caster means mounted dependingly from the rearward end of said frame for rollingly supporting said frame on said floor cooperatively with said brush member;

a driving motor affixed to said frame and drivingly connected with said brush member for driven rotation thereof to produce a scrubbing action of said circular and spiral bristle rows upon their engagement of said grout lines and said upward tile surfaces; and handle means affixed to and extending rearwardly from said frame for permitting manual control of rolling movement of said frame on said floor and for selectively actuating pivotal movement of said frame about said wheel means to vary selectively the force of engagement applied by said brush member to said floor.

* * * * *

UNITED STATES PATENT AND TRADEMARK OFFICE

CERTIFICATE OF CORRECTION

PATENT NO. : 4,586,211

DATED : May 6, 1986

INVENTOR(S) : Dan D. Phillips

It is certified that error appears in the above-identified patent and that said Letters Patent is hereby corrected as shown below:

Column 5, line 14, "group" should be --grout--.

Column 5, lines 47-48, "engagemeent" should be --engagement--.

Signed and Sealed this

*Nineteenth* Day of *August 1986*

[SEAL]

*Attest:*

DONALD J. QUIGG

*Attesting Officer*

*Commissioner of Patents and Trademarks*